United States Patent [19]

Görner

[11] Patent Number: 4,485,980

[45] Date of Patent: Dec. 4, 1984

[54] SUPPORTING ROLLER WINDING APPARATUS

[75] Inventor: Bernd Görner, Weilheim/Teck, Fed. Rep. of Germany

[73] Assignee: Lenox Europa Maschinen GmbH, Kirchheim/Teck, Fed. Rep. of Germany

[21] Appl. No.: 438,420

[22] Filed: Nov. 1, 1982

[30] Foreign Application Priority Data

Oct. 31, 1981 [DE] Fed. Rep. of Germany ..... 3143281

[51] Int. Cl.[3] ..... B65H 19/26; B65H 19/30

[52] U.S. Cl. ..... 242/56 R; 242/66

[58] Field of Search ..... 242/56 R, 56.6, 66

[56] References Cited

U.S. PATENT DOCUMENTS

| | | | |
|---|---|---|---|
| 3,062,465 | 11/1962 | Hunter | 242/56 R |
| 3,365,141 | 1/1968 | Soloduk | 242/56 R |
| 3,817,467 | 6/1974 | Dambroth | 242/56 R |
| 4,345,722 | 8/1982 | Kuhn | 242/56 R |
| 4,370,193 | 1/1983 | Knauthe | 242/56 R X |

FOREIGN PATENT DOCUMENTS 2709684 9/1977 Fed. Rep. of Germany .

*Primary Examiner*—John M. Jillions

*Attorney, Agent, or Firm*—Schwartz, Jeffery, Schwaab, Mack, Blumenthal & Koch

[57] ABSTRACT

A winding device with two supporting rollers, upon which a web is wound onto a winding tube to form a roll. The web may be guided under the first supporting roller from below through a gap between the supporting rollers to the roll. A pivoting winding tube inserter is provided, which carries the winding tube and which may be pivoted over the wedge like space between the two supporting rollers for depositing the winding tube. A blade is arranged over the pivoting range of the tube inserter. The blade is guided closely adjacent to a rim of the tube inserter parallel to the axles of the supporting rollers. Cutting is effected during the run-out of the finished roll under the tension resulting from said run-out and maintained by a braking device acting against the upstream supporting roller in the web.

15 Claims, 6 Drawing Figures

SUPPORTING ROLLER WINDING APPARATUS

BACKGROUND OF THE INVENTION

In the supporting roller winding apparatus described in German Offenlegungsschrift No. 29 20 707 the first supporting roller, around which the incoming web is partially slung, is provided with an axial peripheral groove, into which a blade or a perforator comb may penetrate radially, thereby cutting the web above it. The portion of the supporting roller located in front of the axial groove in the circumferential direction is equipped with perforations, and the supporting roller has the configuration of a suction roll, so that the training end of the paper web is held tightly by suction to the circumference, thereby being maintained under tension for the cutting.

Considerable effort is needed to design one of the support rollers as a suction roll.

SUMMARY OF THE INVENTION

The object of the invention is to provide a supporting roller winding apparatus which makes it possible to cut the web automatically in an efficient and effective manner.

Both supporting rollers may be normal rolls in their configuration. After the completion of the winding, the pivoting tube inserter is in the loading position into which it has been swivelled. The roll is expelled after completion over the tube inserter for example onto a tilting table arranged laterally to said tube inserter. During the expulsion process, the tube inserter pivots the winding tube resting on it over the second supporting roller in a position above the supporting rollers and deposits it by tilting. The tube inserter then swings back immediately. Simultaneously, the moving away of the ejector continues with the web passing over the tube inserter and being tensioned by the moving away of the roll resting on the tilting table. A braking device prevents the pulling of the web. The web tension thus depends on the counter holding force of the braking device. The blade is arranged so that in a certain pivoting position of the tube inserter it may be guided past one of the edges of the tube inserter, with the edge serving as a support for the paper web, and, in this fashion, a certain shearing effect may be obtained. During the passage of the blade along the edge, the cutting of the tensioned web is effected. With a receptacle extending over the width of the web and open in the upward direction for each tube inserter carrying a winding tube, the guidance of the blade may be effected by the outer rim of the receptacle. The use of the edges of the already existing receptacle for the winding tubes in such cases does not exclude that fact that in other cases an edge may be provided on the tube inserter for cooperation with the blade.

A convenient coordination of the movements of the blade and the tube inserter takes place. If the blade is passing the outer edge in a specified angular position, for example 30° to 80°, it may penetrate deeply inside the receptacle, without impacting it. In the process the outer edge of the receptacle represents the highest point upon which the web is resting during the cutting by the blade.

The braking device may consist of an element revolving on the first supporting roller, for example a braking roll abutting against the first supporting roller, preferably, however, it consists of the already existing, endlessly revolving draw-in belt, applied to the first supporting roller. The endless belt may also be used to thread the paper web into the apparatus. This draw-in belt thus performs a second function for the cutting process.

No additional structural parts are required, aside from the blade, for the cutting process according to the invention.

The invention is further embodied by a process wherein the basic concept is that the momentum given to the finished roll during its removal is utilized to effect the cutting at this instant.

DESCRIPTION OF THE PREFERRED EMBODIMENT

Figure 1:
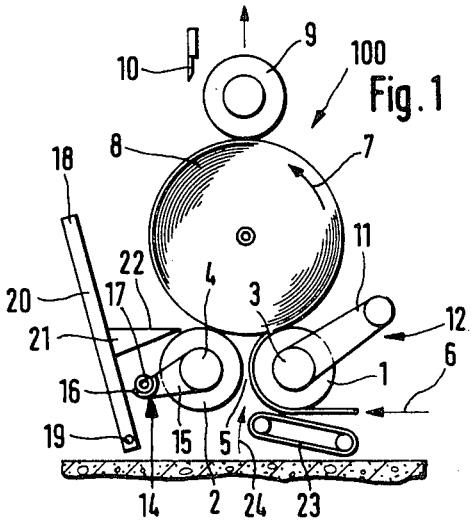
FIGS. 1 to 6 show different phases of the working process of the supporting roller winding apparatus according to the invention.

The supporting roller winding apparatus designated in its entirety by 100 comprises two supporting rollers 1 and 2, revolving around the horizontal axles 3, 4, arranged at the same height and parallel to each other and leaving only a norrow gap 5 between them for the passing of the paper web 6. The paper web enters under the first supporting roller 1, surrounds said first roller over approximately 180° and travels upwards between the supporting rollers 1, 2.

The entering web 6 is wound into a roll 8, supported by the supporting rollers 1, 2 and revolving in the direction of the arrow 7, while a constant pressure is applied to it from above a load roll 9.

Approximately over the supporting roller 2 and above the roll 8, a blade 10 is provided, extending over the width of the web 6; it is displaceable in the vertically downward direction.

Figure 2:
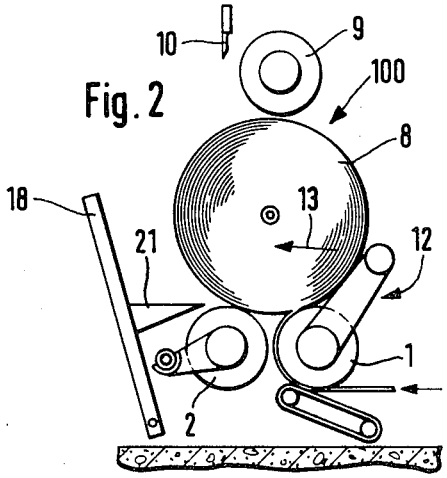

On the axle 3, an ejector 12 is supported on pivoting arms 11, outside the supporting roller 1, which may be swivelled from the position shown in FIG. 1 in the direction of the arrow 13 (FIG. 2).

A tube inserter 14 is pivoted around the axle 4 of the supporting roller 2, which includes on pivoting arms 15 arranged outside the supporting roller 2, a receptacle shell 16, the latter corresponding in its radius to the radii of the winding tubes used and having an approximately semicylindrical configuration. From the loading position shown in FIG. 1, in which the receptacle 16 is open in the upward direction capable of receiving a winding tube 17, the tube inserter 14 may be pivoted into the discharge position shown in FIG. 3, in which the winding tube 17 is tilted out in the wedge between the two supporting rollers 1, 2.

Figure 4:
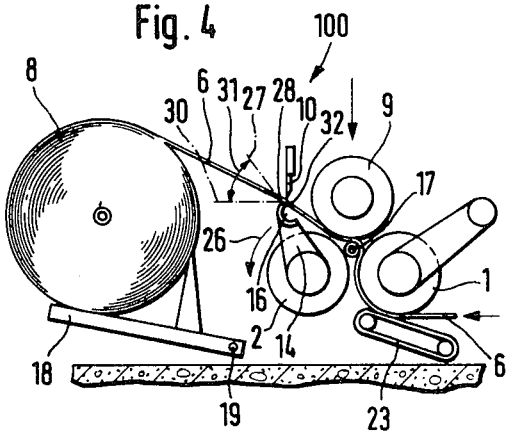

On the side of the tube inserter 14, a tilting table 18 is arranged adjacently to the supporting roller 2. The tilting table may be pivoted around an axle 19 parallel to the axles 3, 4 and it comprises a base plate 20 with an angular support 21 mounted on said base plate in a standing position. In the position shown in FIG. 1, the base plate 20 is tilted upward and the top side 22 of the angular support 21 is approximately horizontal, so that the paper roll 8 may be pressured easily over the supporting roller 2 onto the angular support 21. The tilting table 18 may then be pivoted downward with the roll 8 resting on it, as shown in FIG. 4.

An endless draw-in belt 23 is provided under the roller. It revolves around two axles parallel to the supporting axles 3, 4 and it may be swivelled in the direction of the arrow 24 (FIG. 5) against the supporting roller 1 within the range of the web 6 surrounding the roller 1. The draw-in belt 23 primarily serves to thread the paper web into the apparatus, but also serves as a braking device, as indicated by the description hereinafter of the work process.

FIG. 1 shows the phase during the winding process shortly prior to the completion of the roll 8. The load roll 9 is still in contact with the roll 8 and the ejector 12. The tube inserter 14 and the draw-in belt 23 are in their waiting position.

FIG. 2 shows the phase of the completed roll 8 after braking. The load roll 9 has been raised, the ejector 12 is pivoted against the roll 8 in the direction of the arrow 13 and has already raised the roll 8 from the supporting roller 1, in order to force it over the supporting roller 2 onto the angular support 21 of the tilting table 18.

Figure 3:
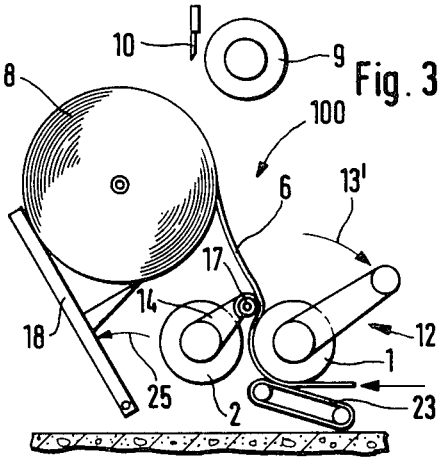

The latter stage has been attained in FIG. 3. The tilting table 18 is beginning to be displaced outwardly in the direction of the arrow 25. The paper web 6 is loose between the roll 8 and the supporting roll 1, but is being braked by the draw-in belt 23 applied against the supporting roll 1. The ejector 12 moves in the direction of the arrow 13' back into its initial position. The tube inserter 14 has been swivelled in the clockwise direction with respect to its position shown in FIG. 2, and at this instant is tilting the winding tube 17 between the two supporting rolls 1, 2.

The phase that is most important for the cutting of the paper web 6 is shown in FIG. 4. The load roll 9 has descended and is pressuring the winding tube 18 partially surrounded by the paper web 6 against the supporting rollers 1, 2. The winding tube 17 is then ready for winding. The tube inserter 14 is in the process of returning into its loading position in the direction of the arrow 26. It has just attained a position wherein the connecting plane 27 of the two upper edges 28 and 29 of the receptacle shell 16 (see also FIG. 5) includes an angle 31 of approximately 55° with the horizontal 30. The upper edge 28 of the receptacle shell 16 is in the highest position so that the web 6 is resting upon it. The web 6 is tensioned tightly because the swivelling of the tilting table 8 around the axle 19 has increased the distance of the roll 8 from the winding tube 17. The tension is countered by the braking effect of the draw-in belt 23. The blade 10 is arranged and its movement coordinated with that of the tube inserter 14, so that in this instant the blade can proceed along the inner edge 32 of the upper edge 28 of the receptacle shell 16. In the process, the web 6, supported by the edge 28, is cut.

Figure 5:
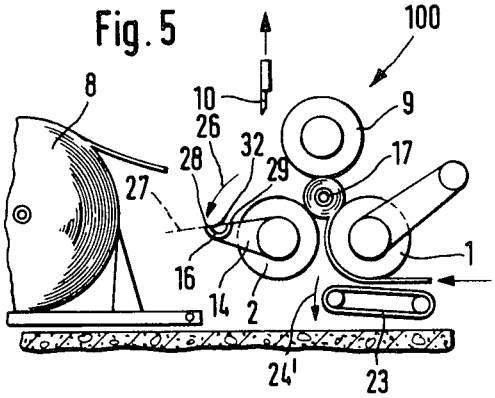

Subsequently, as seen in FIG. 5, the blade 10 ascends and the tube inserter 14 moves on its path into the loading position in the direction of the arrow 26. The draw-in belt 23 is no longer needed and pivots away from the supporting roller 1 in the direction of the arrow 24'. The supporting rollers 1, 2 have started to run. The winding tube 17, which carries a strip of adhesive tape, entrains the end of the web between itself and the blade 10 and has wound it.

Figure 6:
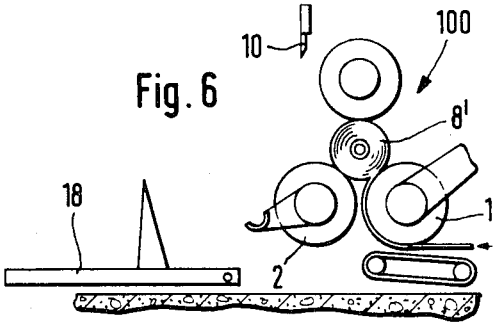

FIG. 6 shows that the completed roll 8 has already been removed from the tilting table 18 and that the new roll 8' is being formed.

What is claimed is:

1. A winding apparatus for winding a web into a roll, comprising:

(a) first and second supporting rollers for supporting said roll, said supporting rollers positioned parallel to one another and spaced apart with the web passing partially around said first supporting roller and into said roll;

(b) a tube inserter pivotally mounted adjacent said second supporting roller and adapted to carry and deposit a winding tube into a position above the supporting rollers and in contact with said web;

(c) a cutting blade extending over the width of the web and positionable for contacting said web for cutting same along a cutting line;

(d) said tube inserter, after depositing said winding tube, pivoted to a position closely adjacent said cutting line, and said tube inserter cooperating with said cutting blade for cutting said web;

(e) an ejector for moving said roll over said tube inserter and second supporting roller, prior to cutting of said web; and (f) a braking device positioned upstream of said blade with respect to the running direction of the web, said braking device actuatable during the cutting of said web.

2. A winding apparatus according to claim 1, wherein said tube inserter comprises a receptacle shell extending over the width of the web and opening in an upward direction for holding said winding tube in an initial position, said web passing between said blade and receptacle shell and said receptacle shell having an outer rim for guiding said blade during cutting of said web.

3. A winding apparatus according to claim 2, wherein said outer rim of said receptacle shell has an inner edge for guiding said blade during cutting of said web.

4. A winding apparatus according to claim 2, wherein the receptacle shell is hemispherical and said outer rim of said shell lies in a plane, said plane making an angle of about 30° to 80° with respect to horizontal during cutting of said web.

5. A winding apparatus according to claim 3, wherein the receptacle shell is hemispherical and said outer rim of said shell lies in a plane, said plane making an angle of about 30° to 80° with respect to horizontal during cutting of said web.

6. A winding apparatus according to claim 1, wherein said braking device comprises a revolving element positioned outside the first supporting roller for removably contacting same in an area in which said web surrounds said first supporting roller.

7. A winding apparatus according to claim 2, wherein said braking device comprises a revolving element positioned outside the first supporting roller for removably contacting same in an area in which said web surrounds said first supporting roller.

8. A winding apparatus according to claim 3, wherein said braking device comprises a revolving element positioned outside the first supporting roller for removably contacting same in an area in which said web surrounds said first supporting roller.

9. A winding apparatus according to claim 4, wherein said braking device comprises a revolving element positioned outside the first supporting roller for removably contacting same in an area in which said web surrounds said first supporting roller.

10. A winding apparatus according to claim 5, wherein said braking device comprises a revolving element positioned outside the first supporting roller for removably contacting same in an area in which said web surrounds said first supporting roller.

11. A winding apparatus according to claim 6, wherein said revolving element comprises an endless loading belt.

12. A winding apparatus according to claim 11, wherein said loading belt is supported on a pair of rollers having longitudinal axes parallel to said supporting rollers.

13. A process for operating a winding apparatus for winding a web into a roll, said apparatus having:

(a) first and second supporting rollers for supporting said roll, said supporting rollers positioned parallel to one another and spaced apart with the web passing partially around said first supporting roller and into said roll;

(b) a tube inserter pivotally mounted adjacent said second supporting roller and adapted to carry and deposit a winding tube into a position above the supporting rollers and in contact with said web;

(c) a cutting blade extending over the width of the web and positionable for contacting said web for cutting same along a cutting line;

(d) said tube inserter, after depositing said winding tube, pivoted to a position closely adjacent said cutting line, and said tube inserter cooperating with said cutting blade for cutting said web;

(e) an ejector for moving said roll over said tube inserter and second supporting roller, prior to cutting of said web; and (f) a braking device positioned upstream of said blade with respect to the running direction of the web, said braking device actuatable during the cutting of said web, said process comprising the steps of:

(g) passing the web between the blade and tube inserter;

(h) guiding the blade past said tube inserter while cutting said web; and (i) maintaining said web under tension by said braking device while cutting said web.

14. A process as recited in claim 13, wherein the tube inserter comprises a receptacle shell extending over the width of the web and opening in an upward direction for holding said winding tube in an initial position, said web passing between said blade and receptacle shell and said receptacle shell having an outer rim for guiding said blade during cutting of said web, said guiding step including guiding the blade past the receptacle shell of said tube inserter while cutting said web.

15. A process as recited in claim 14, wherein said outer rim of said receptacle shell has an inner edge for guiding said blade during cutting of said web, said guiding step including guiding the blade past the inner edge of said receptacle shell of said tube inserter while cutting said web.

* * * * *